US005114051A

United States Patent [19]

Simon

[11] Patent Number: 5,114,051

[45] Date of Patent: May 19, 1992

[54] CLOSING CAPSULE WITH A MOBILE ELEMENT FOR FLASKS AND OTHER CONTAINERS

[76] Inventor: Patrick Simon, 7 rue Theophile Gautier, 95140 Garges Les Gonesse, Val d'Oise, France

[21] Appl. No.: 610,079

[22] Filed: Nov. 7, 1990

Related U.S. Application Data

[63] Continuation-in-part of Ser. No. 308,728, Feb. 9, 1989, abandoned.

[51] Int. Cl.[5] ..... B67D 1/07

[52] U.S. Cl. ..... 222/192; 222/514; 222/517; 222/531; 401/208

[58] Field of Search ..... 222/514, 187, 192, 499, 222/513, 517, 522, 531, 537, 545, 559, 561, 556, 570; 401/11, 139, 202, 208, 213, 216, 219

[56] References Cited

U.S. PATENT DOCUMENTS

| | | | |
|---|---|---|---|
| 3,196,479 | 7/1905 | Romoser | 401/208 |
| 3,263,265 | 8/1966 | Judson | 401/208 X |
| 3,286,885 | 11/1966 | Huling | 222/513 X |
| 3,349,966 | 10/1967 | Schwartzman | 222/187 X |
| 3,696,977 | 10/1972 | Davenport et al. | 222/561 |
| 3,752,370 | 8/1973 | Davenport | 222/514 |
| 4,015,602 | 4/1977 | Nelson et al. | 222/561 X |
| 4,207,996 | 6/1980 | Moen | 222/513 X |
| 4,522,317 | 6/1985 | Goncalves | 222/559 X |
| 4,541,551 | 9/1985 | Vierkotter et al. | 222/561 X |
| 4,555,196 | 11/1985 | De Garmo | 401/208 X |
| 4,637,531 | 1/1987 | Olsson | 222/570 X |
| 4,750,644 | 6/1988 | Kolody | 222/514 X |
| 4,807,781 | 2/1989 | Bobinger et al. | 222/556 X |

FOREIGN PATENT DOCUMENTS

| | | | |
|---|---|---|---|
| 3300190 | 7/1984 | Fed. Rep. of Germany | 222/522 |

*Primary Examiner*—Michael S. Huppert
*Assistant Examiner*—Gregory L. Huson
*Attorney, Agent, or Firm*—Browdy and Neimark

[57] ABSTRACT

A pouring spout assembly comprises an envelope connected to the open upper end of a container by interlocking elements. The envelope has an upper opening adapted to being brought in register with an opening in a slide drawer unit below and having a bottom wall below the drawer unit in which is formed a port communicating with the inside of the container. The drawer unit is provided with a push piece exposed on the outside of the envelope.

15 Claims, 5 Drawing Sheets

CLOSING CAPSULE WITH A MOBILE ELEMENT FOR FLASKS AND OTHER CONTAINERS

RELATED APPLICATION

The present application is a continuation-in-part of application Ser. No. 308,728, filed Feb. 9, 1989, now abandoned.

TECHNICAL FIELD

The present invention relates to closing capsules which are assemblies which fit over the open tops of flasks or other containers and include product-dispensing spouts or the like which at the user's option can be opened or closed.

BACKGROUND OF THE INVENTION

Such capsules have been heretofore developed which include a reciprocating, rocking, rotating or pivoting control member mounted on top of a cover member for selectively opening or closing the spout.

Perhaps the prior art closest to the subject matter of the preferred form of the present invention in U.S. Pat. No. 3,696,977. This patent discloses a pouring spout assembly comprising a manually operable control member slidably disposed on the perimeter of a cylindrical cap member removably secured around a body member, in turn, secured within the open end of the container involved. The slide member engages a stretchable valve member movably secured between the cap member and body member to form a rather complex pouring spout assembly. In the normal non-use position of the slide member, the valve member has an opening misaligned with the spout inlet and a port on the body member communicating with the interior of the container involved. Operating the slide member to a use position brings the valve member port into alignment with the spout inlet and body member port.

The present invention provides a pouring spout assembly which is reliable, easy-to-use and is less complex than the pouring spout assembly of this patent so that it can be manufactured at lower cost than the structure shown in this patent.

SUMMARY OF THE INVENTION

The present invention can have a number of different forms. The preferred form thereof is shown in FIGS. 1-3. All these forms of the invention have a container closing capsule which includes an envelope connectable to the open top of the container by interlocking elements. The envelope has a bottom wall having a port communicating with the open top of the container below it. This port is spaced from and opposite a pouring spout inlet above it. A rigid drawer or slide member is movably disposed in a horizontal guideway formed by the envelope and located above this port. The drawer has an opening movable into register with the port in one extreme position of the drawer in the envelope guideway. It is out of register with this port in the opposite extreme position of the drawer.

In the most advantageous form of the invention shown in FIGS. 1-3 to be described, the envelope has a pair of exposed outer parallel surfaces forming an outer guideway for guiding the movement of the drawer in the envelope guideway. The drawer has a pair of handle-forming outer wings for engaging the parallel wall surfaces of the envelope. The wings guide the drawer for movement between pouring spout opening and closing positions in the envelope guideway. To open the capsule, the user grasps the exposed wings and pulls the drawer outward. The wings preferably are interconnected by a bridging portion which fits neatly into a recess in the envelope where it is preferably flush with the rest of the envelope which forms a neat compact assembly.

Other features of the invention deal with other features of the capsule, such as the unique configurations of the envelope and drawer. Some of these are shown in the FIGS. 1-3 embodiments and some are shown in the other pouring spout assembly structures shown in FIGS. 4-15. These other features of the invention will become more apparent from the hereafter detailed description.

BRIEF DESCRIPTION OF DRAWINGS

Embodiments of the invention are shown, by way of non limiting examples, in the accompanying drawings, wherein.

DETAILED DESCRIPTION

Figure 1:
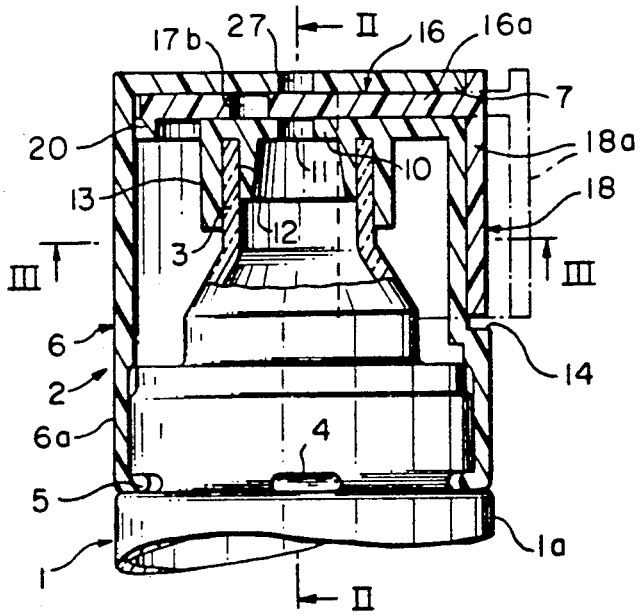
FIG. 1 is a cross sectional view similar to FIGS. 2 and 6 of another alternative embodiment.
Figure 2:
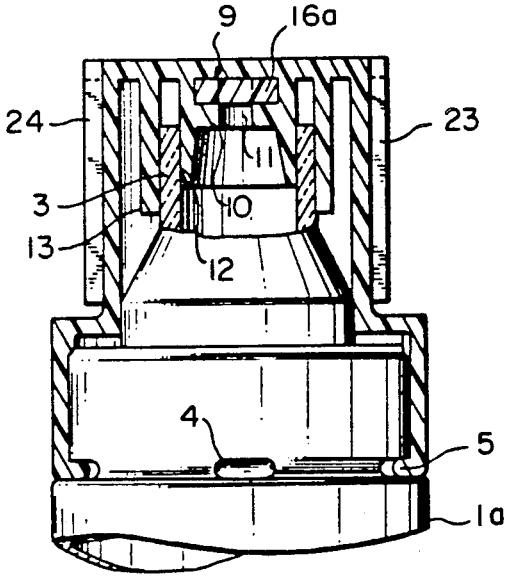
FIG. 2 is a cross sectional view taken along line II—II or FIG. 1.
Figure 3:
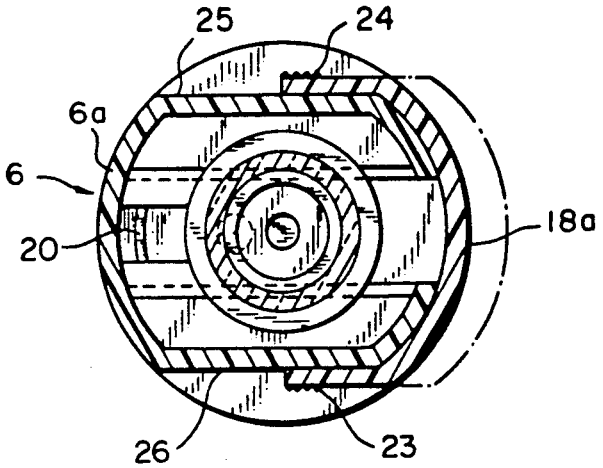
FIG. 3 is a cross sectional view taken along line III—III of FIG. 8.
Figure 4:
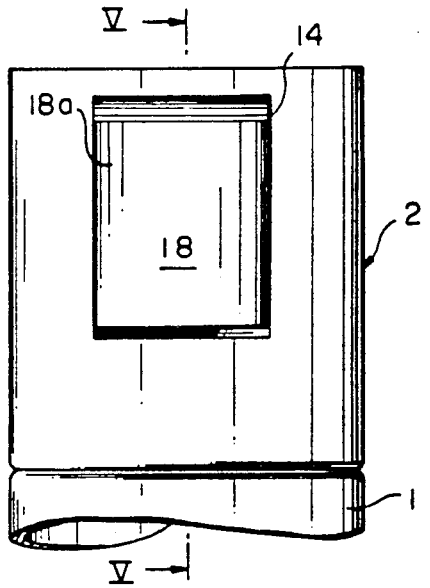
FIG. 4 is an elevation view of a capsule with a slide member according to the invention, with the capsule being put in position on a flask.

Referring now to the drawings, FIGS. 1-3 show the preferred embodiment of the present invention comprising a pouring spout assembly or capsule 2 which closes the open upper end of a cylindrical container 1. The capsule 2 is preferably a two element assembly made of molded synthetic plastic material and including an envelope member 6 and a drawer or slide member 16. The envelope has an outer main body **6*a* preferably having a generally cylindrical shape. The shape and size of the outer body 6*a* between spaced vertical flats 25, 26 thereof is identical to the main cylindrical body 1*a* of the container 1** so that it forms a flush continuation thereof. The container less desirably could have other shapes.

The container 1 has a narrow portion or neck 3 projecting above the container body 1*a*. The body 1*a* has, for example, recesses or grooves 4 which receive in snap-on relation complementary interlocking fingers 5 formed at the bottom of the main outer cylindrical body 6*a* of the envelope 6. Screw threads could be used instead to interconnect the envelope with the container 1. The envelope body 6*a* is provided with an upper horizontal wall 7 having a vertical discharge spout-forming opening or orifice 27 centered therein. A drawer or slide member 16 is sealingly slidably disposed in a horizontal inner guideway or passage 9 formed in the envelope and defined by the bottom of the upper wall 7 and the top of a bottom horizontal wall 10 spaced a small distance below the upper wall 7. The inlet to the orifice 27 communicates with the inner guideway 9. The bottom wall 10 has a port 11 located opposite the inlet to the discharg[illegible] orifice 27. The port 11 communicates between th[illegible]er guideway 9 and the open top of the container ne[illegible] 3.

The drawer 16 includes a handle-forming portion or push-piece 18 and a horizontal valve-forming tongue 16*a* with a vertical valve opening 17*b*. The push-piece 18 includes a pair of exposed, handle-forming wings 23, 24 (FIG. 3) guided on the outer-parallel surfaces or flats 25, 26 of the envelope 6. The wings 23, 24 are advantageously serrated for facilitating the grasping thereof. The push-piece 18 includes a portion 18*a* depending from and bridging the outer ends of the wings 23, 24. It is formed by a curved wall which fits around the inner curved surface of a recess 14 of the same thickness formed in a side of the cylindrical envelope 6. The top of the push-piece is level with the top of the envelope upper wall 7, so that when the push-piece 18 is in its retracted position against the envelope, the curved outer surface of the push-piece wall 18*a* and the outer surface of the envelope 6 are flush, giving the capsule a neat attractive appearance. The valve-forming tongue opening 17*b* of the drawer 16 is then out of alignment with the envelope orifice 27 and port 11 so that the contents of the container 1 cannot be poured from the capsule 2.

To pour the contents of the container 1, the user grips the drawer wings 23, 24 and pulls the drawer into a fully extended position, where a depending projection 20 (FIG. 1) on the valve-forming tongue 16*a* strikes an outer cylindrical skirt 13 depending from the upper wall 7 of the envelope within the cylindrical outer confines of the envelope 6. The valve-forming tongue opening 17*b* then interconnects the orifice 27 in the upper envelope wall 7 and the port 11 in the bottom envelope wall 10.

The envelope 6 has an inner annular skirt 12 depending from the envelope upper wall 7, the skirt 12 extending in sealing engagement with the inner surface of the container neck 3. The inner and outer annular skirts 12 and 13 are concentric and define therebetween an annular groove to snugly receive the container neck 3.

Referring now to FIGS. 4–8 which show a second embodiment of a pouring spout assembly which attaches to the upper portion of the flask 1. It has many common elements to the capsule 2 of FIGS. 1–3 just described. Many of the similar elements of the embodiments of FIGS. 4–8 and FIGS. 1–3, as well as the embodiments of the other drawing figures, have identical reference numerals and so for the most part, only those elements in FIGS. 4–8 which are substantially different in their construction and operation from the elements in FIGS. 1–3 will now be described.

In addition to the foregoing disclosure, the envelope 6 shown in FIGS. 4–8 has in its side wall an inner drawer push-piece-receiving recess 14 defined by parallel walls 15—15 (FIG. 7) projecting inwardly from the cylindrical walls of the envelope 6. The push-piece 18 of the drawer 1,6 depends from the upper wall of the drawer and comprises an outer curved wall 18*a* which is flush with the cylindrical walls of the envelope 6 when the drawer 16 is in its retracted position. It has flanges 18*b*—18*b* which slidably engages the envelope recess walls 15—15. The drawer 16 has a horizontally extending body portion 16*a* defining a horizontal duct or passageway 17 terminating in a pouring spout 17*a* at its outer end and a vertical downwardly facing inlet opening 17*b* at its inner end.

Advantageously, the push-piece 18 includes a resilient element 19 formed by a tongue depending from the top of the upper wall of the drawer 16. The resilient element 19 bears against the container neck 3 in order to maintain the push-piece 18 in an extended spout-closing position spaced from the envelope 6. The pouring spout 17*a* is then retracted within the envelope 6 and the inlet opening of the horizontal passageway and is offset with respect to the envelope bottom wall port 11. When the push-piece 18 is retracted within the envelope recess 14, the resilient element is deformed and the duct inlet opening 17*b* is brought opposite the envelope bottom wall port 11 where the container contents can be caused to flow from the container. The drawer pouring spout then projects beyond the envelope 6 so that the container contents can be easily poured without spilling onto the envelope 6 or container 1. Flow can be enhanced by squeezing the container if it is made of a flexible material.

Figure 5:
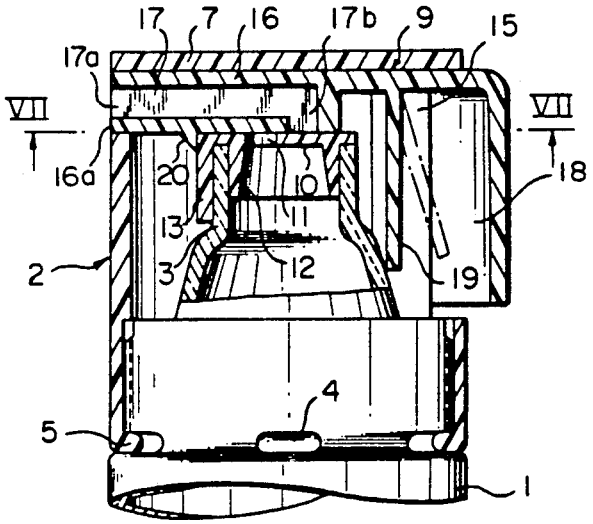
FIG. 5 is a cross-sectional view taken along line V—V of FIG. 1.

In order to prevent the drawer 16 from falling out, the drawer 16 is provided with a protrusion 20 bearing against the envelope flange 13, the drawer 16 is released to assume its non-use position shown in FIG. 5.

Figure 8:
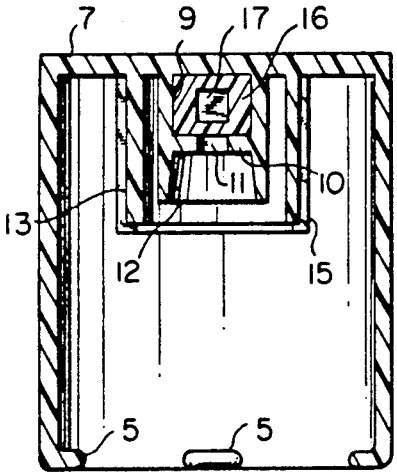
FIG. 8 is a cross-sectional view taken along line VIII—VIII of FIG. 4.
Figure 9:
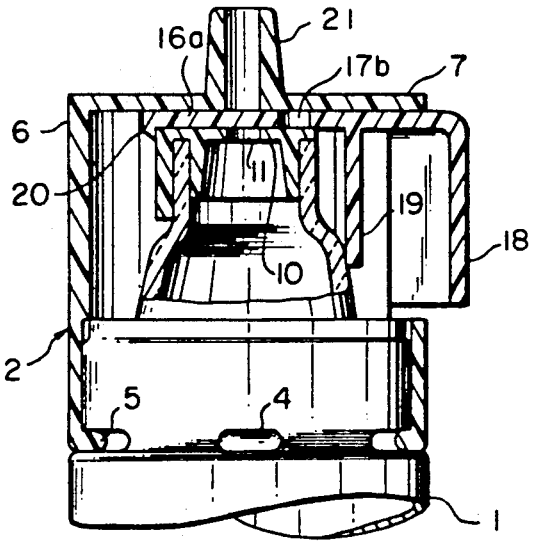
FIG. 9 is a cross-sectional view similar to FIG. 5 of an alternative embodiment.

FIG. 9 shows an alternative embodiment according to which the top wall 7 of the envelope 6 forms, on its top portion, a hollow, vertically projecting pouring spout 21. In this embodiment, the horizontal drawer body 16 is a thin horizontal tongue or plate in which there is formed the opening 17*b* which can be brought in register with the port 11. Other reference numbers designate same members as those described in reference with FIGS. 3–8, and the operation thereof is similar. Thus, the projecting pouring spout has the advantage of the projecting pouring spout of the FIGS. 4–8, namely to prevent dripping of the poured contents onto the flask or capsule 2.

Since the drawer 16*a* is made of a single plate which does not have a resiliency comparable to that of the hollow drawer 16 of FIGS. 5–8, it is advantageous, for ensuring a good tightness between the drawer and the envelope bottom wall 10, to provide on the wall 10 an annular protrusion or pad 22 (see FIG. 10), the function of which is to act as a seal while slightly spacing away the drawer from top of the wall 10. Further, to improve tightness, the annular protrusion or pad 22 aids in positioning the drawer 16 and, in particular, a resilient deformation of the abutment forming protrusion 20.

In FIG. 8, the bottom 7 of the envelope 6 is formed with a hole 27 with which the opening 17*b* of the drawer 16 can be brought in register.

Figure 6:
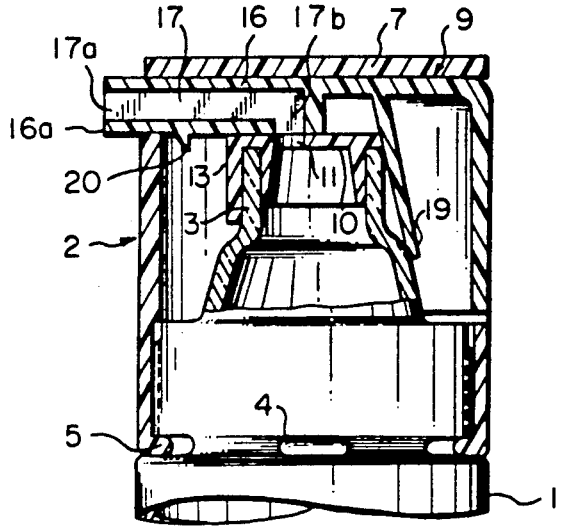
FIG. 6 is a cross-sectional view similar to FIG. 5, showing a characteristic position.
Figure 7:
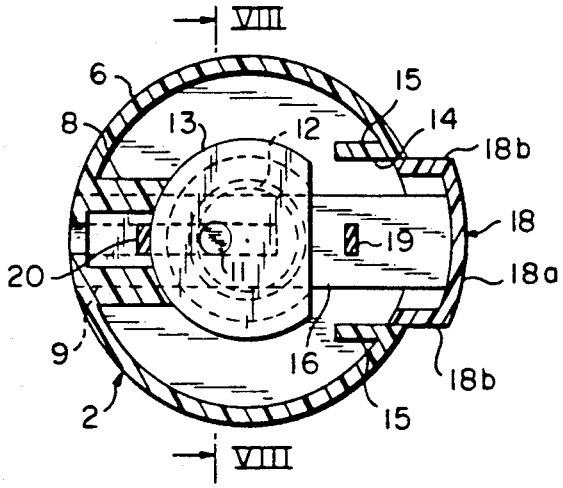
FIG. 7 is a cross-sectional view taken along line VII—VII of FIG. 2.

Obviously, the push-piece 18*a* formed with the wings 23, 24 as just described above can be used in a similar manner in the embodiments of FIG. 6 and of FIGS. 1-5.

Figure 11:
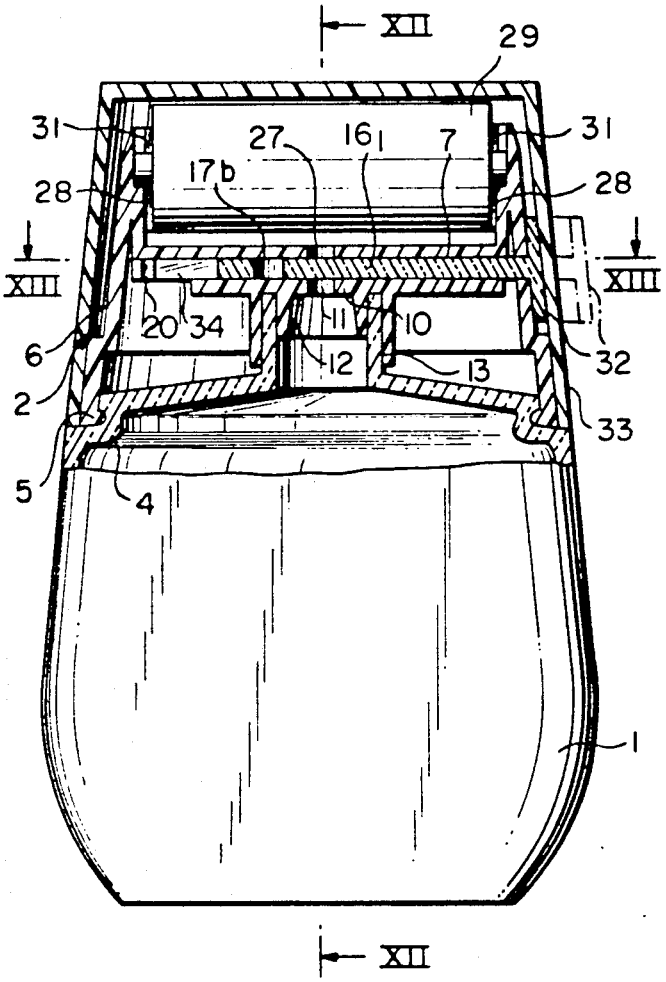
FIG. 11 is an elevation view, partly in cross section, showing a development of the invention together with a further alternative variant.
Figure 12:
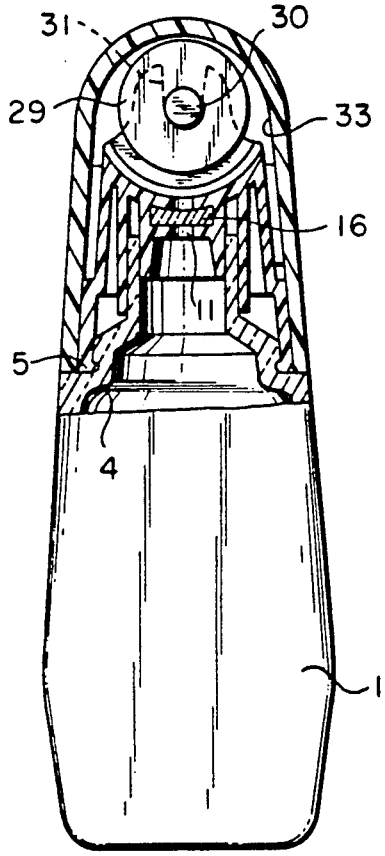
FIG. 12 is a cross sectional view taken along XII—XII of FIG. 11.
Figure 13:
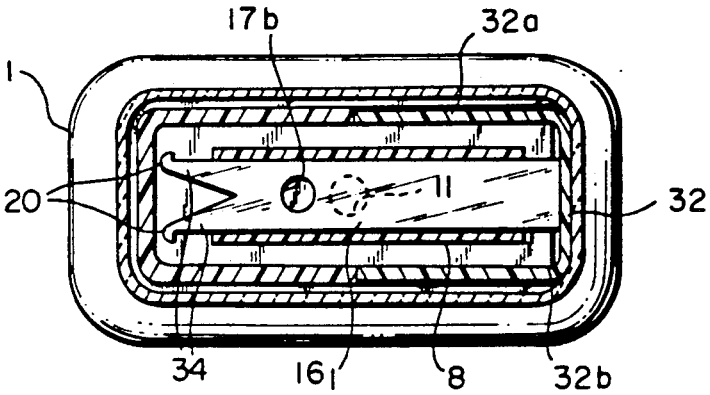
FIG. 13 is a plan view taken along line XIII—XIII of FIG. 11, when two of the members shown in this figure are removed.

FIGS. 11-13 show a development of the invention, as well as an alternative embodiment. In FIGS. 11-13, the envelope 6 forms, above the bottom 7, side flanges 28 for the support of a distributor cylinder 29. The cylinder 29 can be fixed, for example by a snap-in action of end stubs 30 carried by the cylinder 29, inside notches 31 of the flanges 28.

Figure 10:
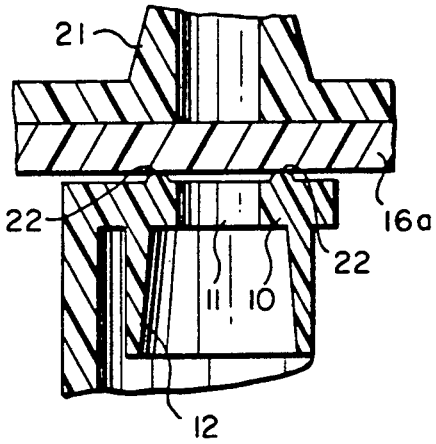
FIG. 10 is an enlarged partial cross sectional view showing a detail of the structure shown in FIG. 9.

In a similar manner as for the part 17*a* of the embodiment of FIGS. 4-8 and for the protruding hollow mouth-piece of the embodiment of FIGS. 9-10, the cylinder 29 forms a means preventing spillage of the flask contents on the flask or capsule.

The bottom 7 is formed, as in FIG. 8, with a hole 27 which can be brought in register with the hole 17*b* of the drawer which is here shown at $16_1$. The drawer 161 is guide by a slide member 8 which is similar as in the embodiment of the preceding figures. The drawer 161 can be operated by a push-piece 32 formed with wings 32*a*, 32*b* advantageously provided with vertical serrations, a grained appearance or prints for housing the user's fingers. The drawer $16_1$ may also be activated by any one of the means described in the above discussed embodiments.

It is advantageous, in the embodiment of FIG. 11, to further provide a cap 33 in order to cover both the whole of capsule 2 and the distributor cylinder 29 that it includes, thereby ensuring a protection of the distributor cylinder 29 which is, on the other hand, integral with the capsule 2. Moreover, the cap 33 provides a locking of the drawer 161 in the closing position.

FIG. 13 shows that the protrusion 20, which forms an abutment, can be provided at the end of each of two lugs 34 of the drawer $16_1$, thereby facilitating a setting in position of the drawer $16_1$ due to the flexibility of the lugs 34.

As in the foregoing disclosure, same reference numerals designate same members as described with reference to the preceding figures.

Figure 14:
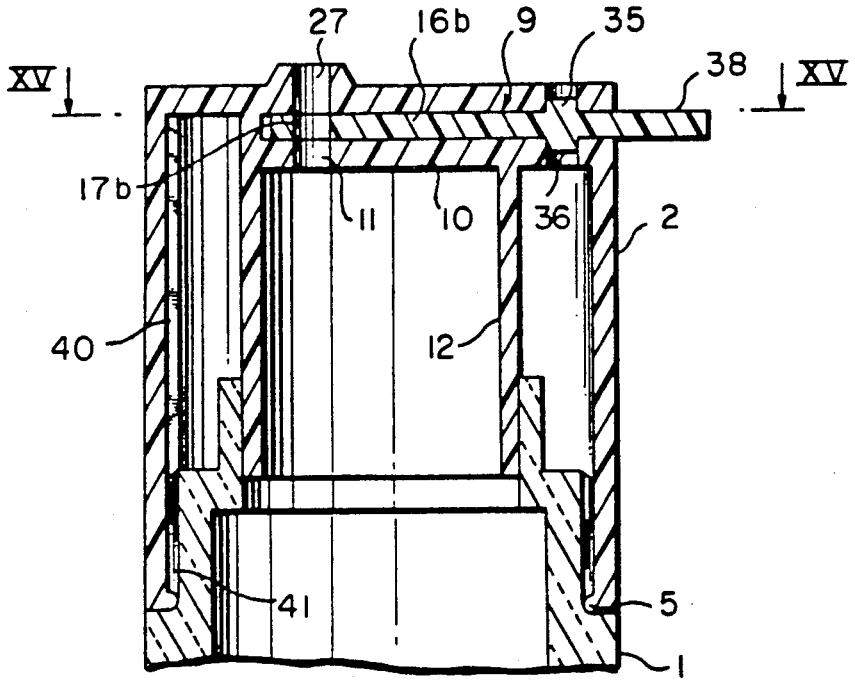
FIG. 14 is a cross sectional elevation view of another variant.
Figure 15:
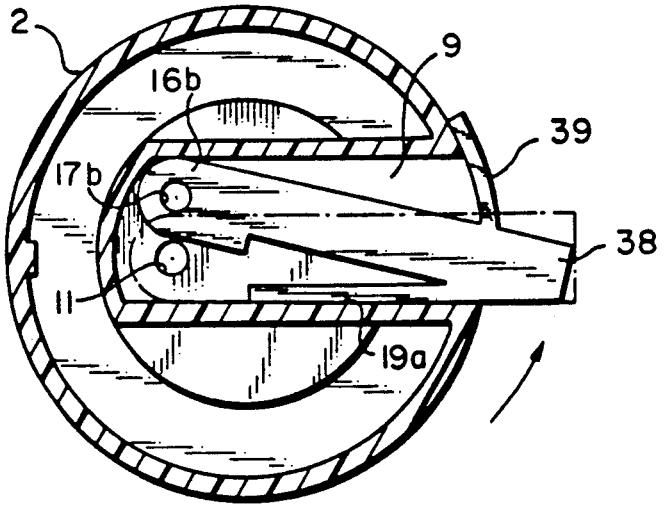
FIG. 15 is a cross sectional view taken substantially along line XV—XV of FIG. 14.

FIGS. 14 and 15 still show another embodiment according to which the passage 9 of the slide member 8 communicates, as previously, with the inside of the flask 1 via the port 11 formed in the wall 10. The port 11 is in alignment with the hole 27 of the bottom 7 of the capsule. In this alternative embodiment, the drawer 16*b* is made of a plane blade articulated via pivot members 25, 26 inside the slide member 8.

A hole 17*b* is formed in the drawer 16*b* in the same manner as in the drawer of FIGS. 6 to 12 so that the hole 17*b* can be brought in register with the hole 27 and port 11.

At rest, the drawer 16*b*, which is of a smaller length than the passage 9, is placed in such manner that the hole 17*b* is offset with respect to the hole 27 and to the port 11, so that the capsule is closed.

As shown in the drawings, the drawer 16*b* includes advantageously a resilient element 19*a* constituted for example of a lug formed opposite a notch 37.

At rest, the lug 19*a* bears against the lateral side of the slide member 8, and thereby maintains the drawer 16*b* so that it closes the port 11 and hole 27.

In order to operate it, the drawer 16*b* forms an operating lug 38 protruding beyond the capsule.

A mask 39 is also formed by the drawer 16*b* so as to close the passage 9.

For avoiding any rotary movement of the capsule 2 during operation of the drawer 16*b*, it is advantageous that the capsule 2 includes a key 40 entering a groove 41 of the flask 1.

The invention is not limited to the embodiments shown and described in detail since various modifications thereof can be carried out thereto without departing from its scope as shown in the appendant claims. In particular, the distributor cylinder 29 can be replaced by other applicator means, for example a porous block, balls or other members. Likewise, the pivoting drawer of FIGS. 14 and 15 can form a duct 17 similar to that described with reference to FIGS. 1 to 5, this duct 17 opening in the lug 38. Moreover, the passage 9 of FIGS. 14 and 15 can be of a circular shape, the drawer being, in that case, made of a disc.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

I claim:

1. A closing capsule for an open-top container which capsule performs the function of selectively opening and closing the open top of the container, said capsule comprising an envelope with means directly removably connectable to the open end of the container where it is immovable relative thereto, said envelope having a discharge passageway having an inlet adapted to be brought into register with an opening in a drawer unit, said envelope having a pair of outer parallel surfaces forming an outer guideway for guiding the horizontal movement of said drawer unit, said envelope also forming an internal generally horizontal guideway, the rigid drawer unit having a pair of outer wings for engaging said parallel wall surfaces which guide the drawer unit for horizontal movement, said drawer unit also having a rigid valve-forming portion having said opening and which is slidably disposed within said internal guideway for horizontal movement therein, said opening in said valve-forming portion of said drawer unit being in register with said inlet to said discharge passageway in a first adjusted position of said drawer unit and being out of register therewith in a second adjusted position thereof, and said envelope having a bottom wall in which is formed a port to communicate with said open end of said container aligned with said drawer unit opening when said drawer unit is in said first adjusted position and to be mis-aligned therewith when said drawer is in a second adjusted position, and said drawer unit being graspable by the user to move said drawer unit between said first and second positions.

2. The closing capsule of claim 1, further comprising cover means for fixedly maintaining said drawer unit in position of no use of said opentop container.

3. The closing capsule of claim 2, wherein said cover means is a cap.

4. The closing capsule of claim 1, wherein said envelope further comprises a support member, a distributor being carried by said support member.

5. The closing capsule of claim 4, wherein said distributor is a cylinder.

6. The closing capsule of claim 4, wherein a snap-in member is further provided for snapingly fixing the distributor on the envelope.

7. The closing capsule of claim 1 wherein said wings of said drawer unit are exposed to the outside of said capsule to be graspable by the user to move said drawer unit between said positions.

8. The closing capsule of claims 1 or 7 wherein said wings of said drawer unit are interconnected at their outer ends by a bridging portion depending therefrom, to form a portion which projects from the adjacent portions of the envelope when the drawer unit is in one of the adjusted positions, said envelope having a recess into which said portion is received when said valve-forming portion is moved into the other of said positions.

9. The closing capsule of claim 8 wherein said envelope has a generally cylindrical configuration so as to form a flush extension of a cylindrical container, said bridging portion of said drawer having a segmental cylindrical outer cylindrical surface which is flush with the adjacent cylindrical surface of the envelope when said bridging portion is in its position retracted within said envelope recess, said opening in said valve forming portion being then out of register with said port.

10. In a closing capsule for an open-top container which capsule can selectively be operated to close the container or to permit its contents to be dispensed from, said capsule comprising: an envelope having an outer envelope body with means on the bottom thereof for connecting the envelope to the open-top of said container, said envelope having an inlet port in its bottom for communication with the open-top of the container and a dispensing passage in the upper portion of said envelope for dispensing the contents of said container through said dispensing passage, said envelope having between said dispensing passage and said inlet port thereof a horizontal guideway, and a control member for selectively connecting and disconnecting said dispensing passage and inlet port, said control member having a valve-forming portion slidable within said guideway, said valve-forming portion having a passageway which in a first extreme position of said control member connects with said inlet port to dispense the contents of said container and in a second extreme position is out of alignment with said inlet port so that the contents of said container cannot be dispensed, and said control member having a finger-engaging portion at one end thereof engageable by the user to move said valve-forming portion between said extreme positions, the improvement wherein said finger-engaging portion of said control member has a first outermost portion at one end of the control member which is respectively adjacent to and spaced from said outer envelope body when said control member is in said different extreme positions, said outer envelope body having a generally cylindrical shape so that when it fits over the open top of a cylindrical container, it forms a flush continuation of the walls of the container, said outer envelope body having a recess in the side thereof adapted to receive said outermost portion of said finger-engaging control member when said first outermost portion is adjacent said outer envelope body, the outer surface of said first outermost portion of said control member being flush with the adjacent portions of said envelope body when the first outermost portion of said control member is adjacent said envelope body portion so as to appear to be an extension thereof.

11. The capsule of claim 10 wherein said passageway in said control member is a horizontally extending passageway terminating in a downwardly facing inlet.

12. In a closing capsule for an open-top container which capsule can selectively be operated to close the container or to permit its contents to be dispensed from, said capsule comprising: an envelope having an outer envelope body with means on the bottom thereof for connecting the envelope to the open-top of said container, said envelope having an inlet port in its bottom for communication with the open-top of the container and a dispensing passage in the upper portion of said envelope for dispensing the contents of said container through said envelope dispensing passage, said envelope having between said dispensing passage and said inlet port thereof a horizontal guideway, and a control member for selectively connecting and disconnecting said dispensing passage and inlet port, said control member having a valve-forming portion slidable within said guideway, said valve-forming portion having a passageway which in a first extreme position of said control member connects with said inlet port to dispense the contents of said container and in a second extreme position is out of alignment with said inlet port so that the contents of said container cannot be dispensed, and said control member having a finger-engaging portion at one end thereof which is engageable by the user to move said valve-forming portion between said extreme positions, the improvement wherein said finger-engaging portion of said control member has an outermost portion which is respectively adjacent to and spaced from said outer envelope body when said control member is in said different extreme positions, said control member passageway in said valve-forming portion thereof terminating in a pouring spout at the other end thereof and which is retracted within said outer envelope body when said outermost portion of said finger-engaging portion of the control member is spaced from said outer envelope body, said pouring spout projecting from said outer envelope body when said finger-engaging portion of said control member is adjacent to said outer envelope body.

13. The capsule as set forth in claim 12, wherein there is resilient means provided for normally urging and maintaining said control member in a position where said outermost portion of said finger-engaging portion of said control member is spaced, from said outer envelope body.

14. The capsule as set forth in claim 10 or 12 wherein said outer envelope body has a top with a pad for forming a seal with the drawer unit.

15. The closing capsule of claims 1, or 10, or 12 wherein said capsule comprises only two molded parts, one being said envelopes and the other being said drawer unit or control member.

* * * * *